US005816867A

United States Patent [19]

Davidsz et al.

[11] Patent Number: 5,816,867

[45] Date of Patent: Oct. 6, 1998

[54] CURVED WIRE SPRING CLAMP WITH OPTIMIZED BENDING STRESS DISTRIBUTION

[75] Inventors: Mark E. Davidsz, Milwaukee; Jeffrey R. Annis, Waukesha, both of Wis.

[73] Assignee: Allen Bradley Company, LLC, Milwaukee, Wis.

[21] Appl. No.: 701,602

[22] Filed: Aug. 22, 1996

[51] Int. Cl.[6] ..... H01R 4/48

[52] U.S. Cl. ..... 439/828; 439/835

[58] Field of Search ..... 439/716, 723, 439/721, 724, 789, 796, 439, 441, 828, 835, 838

[56] References Cited

U.S. PATENT DOCUMENTS

| | | | |
|---|---|---|---|
| 4,171,861 | 10/1979 | Hohorst | 439/94 |
| 4,940,431 | 7/1990 | Hennemann | 439/716 |
| 5,022,873 | 6/1991 | Köllmann | 439/716 |
| 5,071,356 | 12/1991 | Strate et al. | 439/49 |
| 5,334,054 | 8/1994 | Conrad et al. | 439/716 |
| 5,615,079 | 3/1997 | Eggert et al. | 439/716 |
| 5,626,488 | 5/1997 | Albeck et al. | 439/441 |

FOREIGN PATENT DOCUMENTS

| | | | |
|---|---|---|---|
| 4235550 | 4/1994 | Germany | 439/716 |

*Primary Examiner*—Neil Abrams

*Attorney, Agent, or Firm*—John M. Miller; John J. Horn; William R. Walbrun

[57] ABSTRACT

A curved wire spring clamp which distributes bending stresses linearly based on the distance from the point of load application while maintaining torsional integrity. Bending stresses are distributed by providing apertures which change the effective width of the spring along its length. In the preferred embodiment the apertures approximate a triangular cantilever and are centrally placed along each leg portion near a constrained curved portion of the spring to change the spring's bending characteristics and distribute the bending stress more evenly throughout the length of the spring thereby reducing the peak bending stress level as compared with an equivalent spring design without apertures.

A loop shaped flat spring, consisting of curved portions and nearly straight portions with a decreasing effective width to the point of load application provides a more efficient design than a similarly shaped spring of constant width which reduces the bending stress at the constrained portions by distributing the bending stress throughout the straight portions.

16 Claims, 2 Drawing Sheets

CURVED WIRE SPRING CLAMP WITH OPTIMIZED BENDING STRESS DISTRIBUTION

FIELD OF INVENTION

This invention relates generally to an electrical terminal device and, more particularly, it relates to a curved wire spring clamp with optimized bending stress distribution.

BACKGROUND OF THE INVENTION

Some electrical wiring applications permit the use of screwless terminal blocks for quick and easy electrical connections. In general, a screwless terminal block incorporates a bus bar and clamping springs which have a constant width and thickness and sustain a high degree of stress in their constrained curved portions as compared with the straighter portions when flexed. As a result, in use, the higher stresses increase the likelihood of stress relaxation or premature failure from fatigue. Additionally, exceeding maximum stresses can result in permanent deformation such that the spring's shape and spring rate are undesirably changed.

It is possible to reinforce the curved portions by increasing the thickness along only the constrained portions, however such a spring is not easily manufacturable. Furthermore, increasing the entire spring's thickness alone is not an efficient use of raw materials and may undesirably increase the force required to actuate the spring and its cost.

Accordingly, there is a present need for a curved spring with optimized bending stress distribution in order to extend the spring's useful life by preventing the stresses from exceeding a maximum specified stress along the entire length of the spring, especially in the constrained portions. More specifically, there is a need for an efficient spring design which uniformly distributes bending stresses throughout the spring's length which, in turn, reduces stress relaxation, maximizes wire clamp loads, reduces overall spring size, and aids in increasing a spring's maximum working range.

SUMMARY OF THE INVENTION

In accordance with the present invention there is provided a curved wire spring clamp which distributes bending stresses in a manner which decreases the stress upon a constrained curved region while maintaining torsional integrity. In particular, bending stresses are distributed by providing apertures which change the effective width of the spring along its length. In the preferred embodiment the apertures approximate a triangular cantilever and are centrally located along select leg portions of the spring near a constrained curved portion thereby changing the spring's bending characteristics and correspondingly distributing the bending stress more evenly throughout the length of the spring.

Typically, tapering the thickness of a section to obtain a nearly constant bending stress in a long thin spring material is difficult to achieve and not very manufacturable. However, the approach of varying the spring's effective width via an aperture as disclosed in the present invention is easily achieved using conventional stamping tools and dies.

A loop shaped flat spring, consisting of at least one curved portion and nearly straight portions with a decreasing effective width proximal the curved portion provides a more efficient design than a similarly shaped spring of constant width. Moreover, the provision of stress relieving apertures decreases the effective spring width to approximate a triangular cantilever such that bending stresses are distributed throughout the leg portions, and correspondingly reduced in the constrained curved region.

It is therefore an object of the present invention to provide a curved wire spring clamp in which bending stresses are distributed more uniformly along the spring's entire length and not concentrated only at the curved region.

It is a further object of the present invention to provide a curved wire spring clamp wherein bending stresses are reduced proximal the constrained curved region.

It is yet another object of the present invention to provide a longer life curved wire spring clamp.

DETAILED DESCRIPTION OF THE PREFERRED EMBODIMENT

Figure 1:
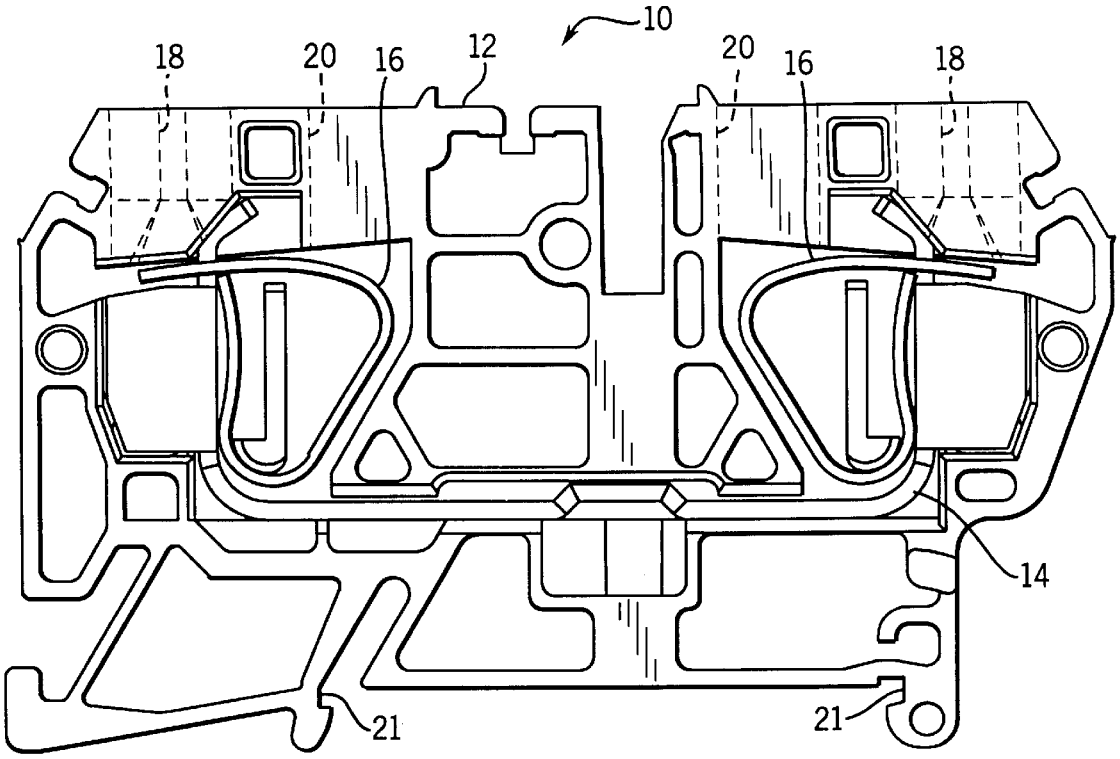
FIG. 1 is a front view of a curved spring clamp integrated within a molded plastic terminal block housing in accordance with the preferred embodiment of the present invention.

With reference to FIG. 1 there is shown an electrical terminal block 10 which incorporates the improved spring clamp of the present invention. In general, screwless terminal block 10 comprises a molded plastic housing 12, a copper alloy current bar 14 and spring clamps 16. As shown, both the spring clamps 16 and current bar 14 are fitted within housing 12. The housing 12 also defines wire raceways or conductor pathways 18 and channels 20 and slots 21 for connecting the terminal block 10 to a mounting rail (not shown).

Figure 2:
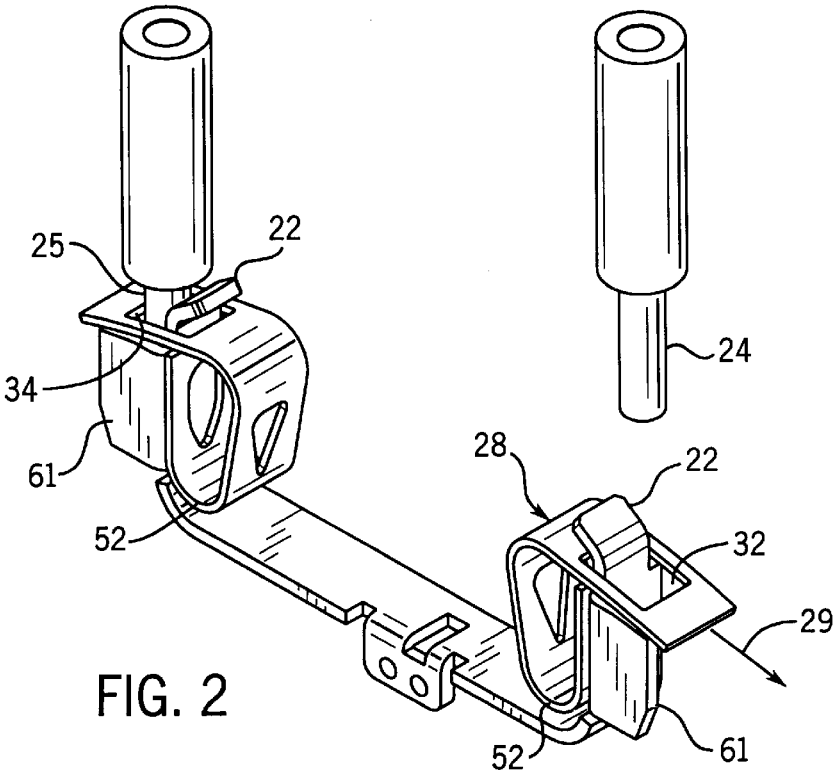
FIG. 2 is a perspective view of a curved spring clamp mounted on a current bar in accordance with the preferred embodiment of the present invention.

FIG. 2 depicts the arrangement of spring clamps 16 and current bar 14 in the preferred embodiment. In particular, wire retaining apertures 32 in each spring clamp 16 are fitted over the tangs 22 at the ends of current bar 14 such that the springs, by their own spring force, maintain engagement with the current bar. Thereafter, the entire current bar 14 and spring assembly is fitted within housing 12 as shown in FIG. 1.

In use, a screwdriver or similar implement (not shown) is inserted within channel 20 defined by housing 12 where it is guided along a path extending between the housing and the spring clamp 16. In this manner a force is exerted on the spring 16 in the direction indicated by arrow 28. As a result, the spring 16 bends about its curved portion 52 causing the wire retaining aperture 32 to translate in a direction 29 from its original position inside the current bar tang 22 to the outside of the current bar tang. Aperture 32 is then aligned with the wire raceway 18 defined by the housing 12 and the wire 24 may be fully inserted therein. After proper insertion of the wire 24, the screwdriver or similar implement is removed from the channel 20 thereby removing the applied force along direction 28 causing the spring clamp 16 to try to return to its original position, thus clamping the wire. In the clamping position, the inner wall 34 (shown in FIG. 3) of the wire retaining aperture 32 engages the wire 24 against the current bar tang 22 and outer surface of current bar 14. Wire 24 is further confined with the housing 12 by a flange 61 defined by the current bar 14 as depicted in FIGS. 1 and 2. In a similar manner a second wire 25 may be inserted within the opposing wire raceway 18 to form an electric circuit from wire 24 along the current bar 14 to the opposing current bar tang 22 and wire 25.

Figure 3:
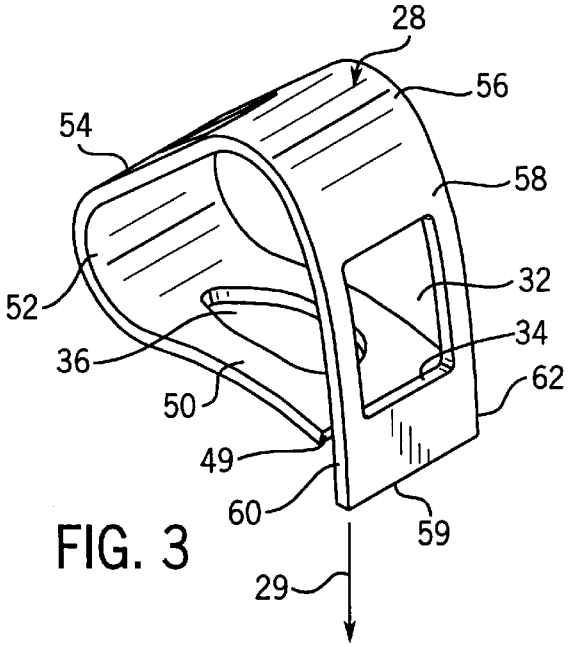
FIG. 3 is a perspective view of a spring clamp in accordance with the preferred embodiment of the present invention.
Figure 4:
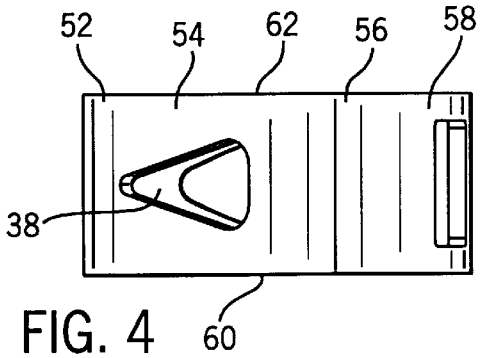
FIG. 4 is a top view of a spring clamp in accordance with the preferred embodiment of the present invention.
Figure 5:
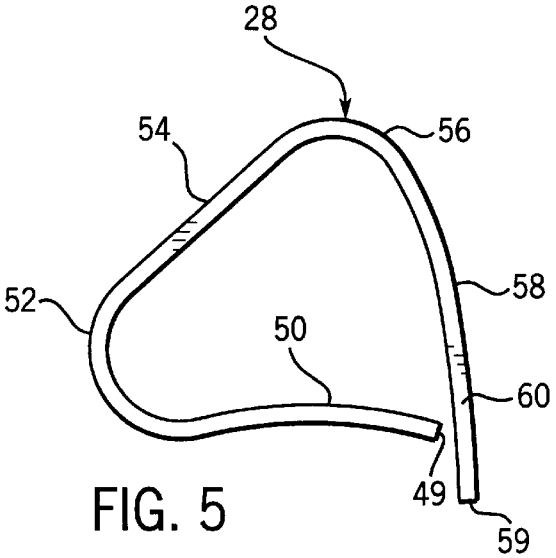
FIG. 5 is a front view of the spring clamp in accordance with the preferred embodiment of the present invention.

With respect to FIGS. 3–6 there is shown the curved spring clamp 16 of the present invention. As shown in FIG. 5, clamp 16 is generally loop shaped. Starting from a first end 49 the spring 16 is comprised of a bottom leg portion 50, a first curved portion 52, a top leg portion 54, a second curved portion 56 and a third leg portion 58 which defines a second spring end 59.

The clamping springs 16 may be manufactured by stamping a rectangular shape from a flat strip of metal. Similarly, apertures 36 and 38 and the wire retaining aperture 32 are stamped into the flat rectangular piece. Thereafter, the flat shape is permanently deformed to form the first curved portion 52 and the second curved portion 56 to form the spring clamp 16. In the preferred embodiment, the curved spring 16 has a constant width from a first edge 60 to a second edge 62 although the effective width varies as discussed below. When assembled on the current bar 14 and placed in housing 12 the first curved portion 52 becomes constrained.

As discussed above, application of a load in the direction of arrow 28 normally causes increased stress at the constrained portion 52. However, in the preferred embodiment shown apertures 36 and 38 are stamped in the spring 16 to decrease the effective width of the spring along the portions 50 and 54, respectively, proximal the first curved portion 52. As shown, the width of the apertures 36 and 38 are smallest proximal curved portion 52 and increase in size along the length of leg portions 50 and 54, respectively. In this manner the effective width along the leg portion 50 and 54 is decreased along a path away from the first curved portion 52. As a result the rigidness of the leg portions 50 and 54 decreases along the path away from curved portion 52. Conversely, the flexibility of the leg portions 50 and 54 is increased along the path away from first curved portion 52. A similar result would occur if the edges 60 and 62 along the leg portions 50 and 54 were increasingly tapered along the path heading away from the first curved portion 52. However, tapering edges 60 and 62 would leave a narrow width of spring that is more susceptible to fatigue from torsional forces, which may be applied to the spring 16 in use.

In the preferred embodiment, apertures 36 and 38 approximate a triangular cantilever in shape. More specifically, apertures 36 and 38 decrease the effective width of the leg portions 50 and 54, respectively, which causes the spring rate to decrease over the length of the spring. However, the spring rate is restored to that of a similar spring without apertures 36 and 38 by slightly increasing the spring thickness over the entire length of the spring. Moreover, since the spring rate varies directly with the third power of thickness and stress varies inversely with the second power of thickness, a lower stressed spring with an equivalent spring rate is achieved by slightly increasing the thickness when the apertures 36 and 38 are incorporated in the spring 16.

With reference to FIG. 3 a perspective view of spring clamp 16 shows the position of aperture 32 when the spring is in its free state and not mounted on current bar 14. As shown, the inner wall 34 does not extend beyond the first end 49 of the spring. Additionally, aperture 32 is preferably rectangular in shape in order to facilitate ease of mounting on the current bar tang 22.

With reference to FIG. 4 aperture 38 is generally triangular in shape. As discussed above, the aperture 38 decreases the effective width of the spring although the distance between edges 60 and 62 may remain relatively constant. Also, the aperture 38 is preferably located such that a corner of the triangular shape is centrally placed between the edges 60 and 62 at a point where the first curved region 52 meets with the second leg 54. As such, the effective width of the leg portion 54 is decreased along the path from the first curved region 52 to the second curved region 56. As a result, the flexiblity of leg portion 54 increases which decreases the bending stress on first curved region 52 providing a more uniform stress distribution along leg portion 54.

With respect to FIG. 5 there is shown a front view of the spring 16. As shown, the legs 50, 54 and 58 are either slightly curved or straight, so that the curvature of leg portions 50, 54 and 58 is less than either of the curved regions 52 or 56. When leg portion 50 is curved and the spring 16 is installed the leg 50 does not make contact with the current bar 14 along its entire length. Rather, the leg portion 50 contacts the current bar 14 near its first end 49 and the area where the first leg portion 50 meets the first curved portion 52 until flexed.

Figure 6:
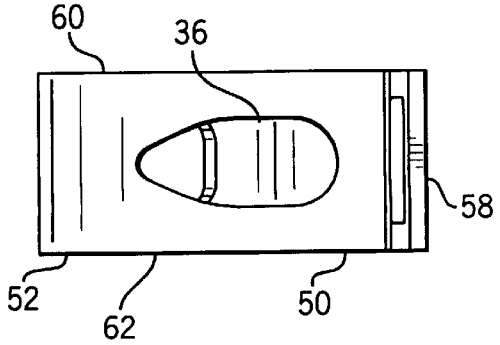
FIG. 6 is a bottom view of the spring clamp in accordance with the preferred embodiment of the present invention.

With respect to FIG. 6 there is shown a bottom view of the spring 16. Aperture 36 is generally tear drop shaped and slightly larger in area than aperture 38. In the preferred embodiment the apex of the tear drop is located equidistant from the edges 60 and 62 and proximal the location where the leg 50 and curved region 52 meet. In this manner the effective width of leg portion 50 is decreased along the path from the curved region 52 to the first end 49 although the actual width between edges 60 and 62 remains constant. As a result, the decreased effective width increases the flexiblity of leg portion 50 which correspondingly decreases the bending stress on first curved region 52 providing a more uniform stress distribution along leg portion 50.

While a particular embodiment of the present invention has been shown and described, it should be clear that changes and modifications may be made to such embodiment without departing from the true scope and spirit of the invention. For example, apertures 36 and 38 are shown to generally approximate a triangular cantilever, however other shape apertures may be employed having a similar effect. It is intended that the appended claims cover all such changes and modifications and others not specifically mentioned herein.

What is claimed is:

1. A spring clamp for use in screwless terminal block comprising a housing and a current bar, said spring comprising:

a first leg portion having a first end and defining a first stress relieving aperture;

a first curved portion contiguous with said first leg portion;

a second leg portion contiguous with said first curved portion, said second leg portion defining a second stress relieving aperture;

a second curved portion contiguous with said second leg portion;

a third leg portion contiguous with said second curved portion, said third leg portion defining a third aperture;

wherein said first leg portion, said first curved portion, said second leg portion, said second curved portion and said third leg portion generally define a loop shape.

2. The spring clamp as set forth in claim 1 wherein said third aperture is sized to accept a portion of said current bar and when accepted said first leg portion and said third aperture releasably engage said current bar.

3. The spring clamp as set forth in claim 1 wherein said first leg defines an arc having a radius of curvature greater than a radius of curvature of either said first or second curved portions such that said first leg engages said current bar along said first end and a point where said first leg and said first curved portion meet.

4. The spring clamp as set forth in claim 1 wherein said first aperture is generally triangular in shape.

5. The spring clamp as set forth in claim 1 wherein said second aperture is generally triangular in shape.

6. The spring clamp as set forth in claim 4 wherein said second aperture is generally triangular in shape.

7. The spring clamp as set forth in claim 1 wherein said first aperture is tear drop shaped.

8. A curved spring for use in a screwless terminal block comprising a housing and a current bar, said spring comprising:

a rectangular piece of metal defining a length between a first end and a second end, a width and a thickness, said thickness being substantially less than said length or width, said rectangular shape permanently deformed along said length in at least two areas between said first and second ends such that said piece of metal is loop shaped, said rectangular piece of metal further defining at least one stress relieving aperture and a wire retaining aperture, said at least one stress relieving aperture located proximal one of said at least two areas nearest said first end and said wire retaining aperture located proximal said second end.

9. The spring as set forth in claim 8 wherein said wire retaining aperture is sized to accept a portion of said current bar and when accepted said first end and said wire retaining aperture releasably engage said current bar.

10. The spring clamp as set forth in claim 8 wherein said at least one stress relieving aperture is generally triangular in shape.

11. A curved spring clamp for use in a screwless block comprising a housing and a current bar, said spring comprising:

a first leg portion having a first end and defining a first stress relieving aperture, said first leg portion further defining a first arc having a first radius of curvature;

a first curved portion contiguous with said first leg portion, said first curved portion defining a second arc having a second radius of curvature;

a second leg portion contiguous with said first curved portion, said second leg portion defining a second stress relieving aperture;

a second curved portion contiguous with said second leg portion, said second curved portion defining a third arc having a third radius of curvature, said first radius of curvature being substantially greater than said second radius of curvature and said third arc;

a third leg portion contiguous with said second curved portion, said third leg portion defining a third aperture and a second end;

wherein said first leg portion, said first curved portion, said second leg portion, said second curved portion and said third leg portion generally define a loop shape between said first end and said second end.

12. A curved spring for use in a screwless terminal block comprising a housing and a current bar, said spring comprising:

a first leg portion defining a first end;

a first curved portion contiguous with said first leg portion;

a second leg portion contiguous with said first curved portion;

a second curved portion contiguous with said second leg portion;

a third leg portion contiguous with said second curved portion and defining a wire retaining aperture and a second spring end; and a means for relieving bending stress in said first curved portion defined by at least one of said first leg portion, said first curved portion, said second leg portion;

wherein said first leg portion, said first curved portion, said second leg portion, said second curved portion and said third leg portion generally define a loop shape between said first end and said second end.

13. The spring as set forth in claim 12 wherein said wire retaining aperture is sized to accept a portion of said current bar and when accepted said first leg portion and said wire retaining aperture releasably engages said current bar.

14. The spring as set forth in claim 12 wherein said first leg defines an arc having a radius of curvature greater than a radius of curvature of either said first or second curved portions such that said first leg engages said current bar along said first end and a point where said first leg and said first curved portion meet.

15. The spring clamp as set forth in claim 12 wherein said means for relieving bending stress is generally triangular in shape.

16. The spring clamp as set forth in claim 12 wherein said means for relieving bending stress is generally a tear drop shape.

* * * * *